United States Patent [19]

Skoog

[11] Patent Number: 4,726,760

[45] Date of Patent: Feb. 23, 1988

[54] METHOD OF AND APPARATUS FOR BURNING LIQUID AND/OR SOLID FUELS IN PULVERIZED FORM

[75] Inventor: Kurt Skoog, Väddö , Sweden

[73] Assignee: Stubinen Utveckling AB, Sweden

[21] Appl. No.: 859,466

[22] Filed: May 5, 1986

[30] Foreign Application Priority Data

Jun. 10, 1985 [DE] Fed. Rep. of Germany ..... 3520781

[51] Int. Cl.[4] ..... F23C 5/00

[52] U.S. Cl. ..... 431/8; 431/187; 110/265; 110/347; 239/406; 239/422

[58] Field of Search ..... 431/8, 9, 115, 181, 431/182, 183, 186, 187, 284; 110/263, 264, 265, 347; 239/399, 400, 403, 405, 406, 418, 419, 419.3, 422, 423, 424, 428, 432

[56] References Cited

U.S. PATENT DOCUMENTS

| | | | |
|---|---|---|---|
| 1,512,132 | 10/1924 | Pfahl | 431/187 |
| 1,565,111 | 12/1925 | Sommer | 431/187 |
| 1,679,830 | 8/1928 | Lang | 431/187 |
| 2,044,720 | 6/1936 | Fletcher | 239/422 X |
| 2,072,281 | 3/1937 | Simonin | 239/432 |
| 2,219,696 | 10/1940 | Mueller et al. | 239/419 |
| 2,834,407 | 5/1958 | Mason | 431/187 |
| 3,630,024 | 12/1971 | Hopkins | 239/406 |
| 4,569,295 | 2/1986 | Skoog | 110/265 X |

FOREIGN PATENT DOCUMENTS

| | | | |
|---|---|---|---|
| 701091 | 12/1940 | Fed. Rep. of Germany | 239/422 |
| 1164013 | 2/1964 | Fed. Rep. of Germany . | |
| 2350151 | 4/1974 | Fed. Rep. of Germany | 239/406 |
| 2724532 | 12/1978 | Fed. Rep. of Germany . | |
| 145316 | 7/1979 | German Democratic Rep. . | |

*Primary Examiner*—Margaret A. Focarino
*Attorney, Agent, or Firm*—Lorusso & Loud

[57] ABSTRACT

A method of and an apparatus for burning liquid and/or solid fuels, especially coal or the like, in pulverized form, the latter either in dry condition or mixed with a carrier liquid such as water and/or oil to form an emulsion being introduced together with the fuel into a combustion chamber to create a spray cone which opens approximately conically, said spray cone being bounded by an external, optionally rotating flow of air. In order to form minute fuel particles immediately downstream of the fuel inlet, the latter is constituted by a central port which is defined by a continuous knife edge. Furthermore, an approximately radially directed air inlet port is associated with said central port on the side remote from the combustion chamber.

13 Claims, 1 Drawing Figure

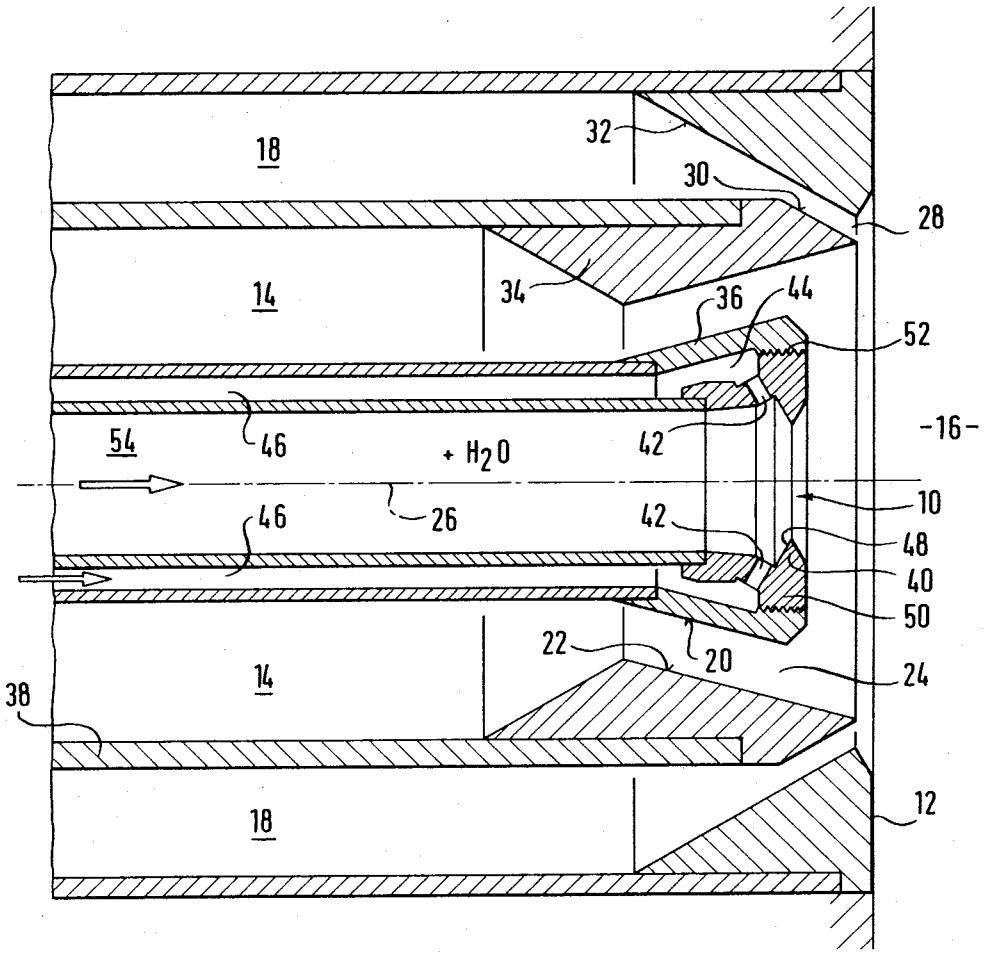
-16-
28
52
10
48
40
50
24
12
44
36
30
32
34
42
42
20
22
$H_2O$
26
18
14
46
46
14
18
54
38

METHOD OF AND APPARATUS FOR BURNING LIQUID AND/OR SOLID FUELS IN PULVERIZED FORM

BACKGROUND OF THE INVENTION

The invention is concerned with a method of and an apparatus for burning liquid and/or solid fuels in accordance with the preambles of patent claims 1 and 7, respectively.

Over the years the most varied proposals have been made for burning both liquid fuels such as oil or the like and solid fuels, especially coal, peat or the like in pulverized form, the latter being mostly introduced into a combustion chamber in admixture with a carrier liquid such as water and/or oil to form an emulsion. Introduction of the fuels into the combustion chamber normally takes place while creating a recirculating flow profile, the latter being confined by a rotating outer flow or air. In practice, combustion of a suspension of pulverized coal in liquid has proven to be relatively difficult; the main problem resides in preventing clogging of the fuel inlet ports or burner nozzles opening into the combustion chamber. Also, the combustion efficiency has been limited. To overcome these problems, the DD-PS No. 145,316 proposes a burner which is a combination of a so-called rotational burner and a toroidal burner. However, tests have shown that only relatively low efficiencies can be achieved with this burner, above all during the critical starting phase. The reason probably is that atomization of the fuels is insufficient so that problems of ignition will arise especially during the starting phase. Also, enrichment or mixing of the fuels with air is insufficient, whereby the efficiency is likewise reduced. Proceeding from the above-specified prior art it is the object of the instant invention to provide a method of and an apparatus for burning liquid and/or solid fuels in pulverized form, in which practically complete combustion can be achieved with simple structural means, wherein highly efficient combustion can also be maintained when solid fuels in dry state are supplied.

SUMMARY OF THE INVENTION

In the invention, the fuels are introduced into the combustion chamber with spontaneous fanning-out and in very finely divided state. Of particular importance is not only the introduction of the fuels into the combustion chamber by way of a knife-like edge but the additional admixture of compressed air prior to introduction into the combustion chamber, so that fuel highly enriched with air enters the combustion chamber. Preferably, the compressed air is admixed immediately before introduction of the fuel into the combustion chamber, viz. approximately radially towards the fuel, but preferably at a slight inclination to the fuel inlet port. Thus the fuel is broken up and enriched with air to promote combustion already before entering the combustion chamber. In addition, the thus created fuel spray cone, which is substantially hollow, is bounded by an outer, approximately similarly directed flow or primary air immediately after entry thereof into the combustion chamber. Finally, a radially even farther outward flow of secondary air acts on the thus "enveloped" spray cone whereby the flow surface or spray cone is broken up. That is, the flow of secondary air is directed towards the spray cone.

Thereby the fuels introduced into the combustion chamber are spontaneously broken up immediately downstream of the fuel inlet whereby minute fuel particles or droplets are formed. In this way a maximum-efficiency fuel surface is obtained immediately downstream of the fuel inlet, whereby practically complete combustion is achieved within an extremely short distance. The combustion chamber may be correspondingly short and small, even when solid pulverized fuels are burned.

Surprisingly, the method according to the invention is suitable for burning oil and also for burning solid fuels in dry state and for burning a mixture of said fuels. When solid fuels are subject to combustion, however, it is appropriate and in most cases necessary also to admix readily combustible oil for the start-up operation in order to initiate combustion. The oil supply may then be stopped after initiation of combustion and possibly be replaced by water so that the solid fuel particles can be more readily charged and introduced into the combustion chamber.

Of particular significance in respect of the apparatus is the continuous knife edge defining the fuel inlet port and the air inlet ports associated with said knife edge, said fuel inlet ports being preferably disposed direct on the side of the knife edge remote from the combustion chamber and extending approximately radially.

Useful solid fuels mainly comprise coal, e.g. hard coal, bituminous coal, high-gas coal or a mixture thereof. The apparatus according to the invention is also suitable for burning heavy oils. Thus, the apparatus is useful for burning substances which normally are not readily combustible.

BRIEF DESCRIPTION OF THE DRAWINGS

The invention will be described in detail with reference to an embodiment of an apparatus for performing the method according to the invention. This embodiment is illustrated in the drawing as a schematic cross-sectional view. The drawing only illustrates a portion of the apparatus according to the invention, i.e. the burner section with fuel and air inlet portion. The peripheral portions associated with said inlets and the combustion chamber have been omitted to facilitate understanding of the gist of the invention.

DETAILED DESCRIPTION OF THE PREFERRED EMBODIMENTS

The oil and/or coil burner illustrated in the drawing as a schematic longitudinal section comprises a jet body 36 with a central fuel inlet opening to the combustion chamber 16 and being configured as a fuel inlet port 10 which is recessed in the end wall 12 of the combustion chamber 16 and is concentrically surrounded by two gas passageways 14, 18. The gas passageway 14 which directly surrounds the jet body 36 opens into the combustion chamber 16 via a gas or air inlet port 24 which is nearest to the fuel inlet port 10. So-called "primary air", which may be enriched with higher-temperature combustion gases, flows through the passageway 14, and the gas exiting from the port 24 has a flow rate of 100 to 200 m/s, preferably about 130 m/s. Each of the side walls 20 and 22 defining the port 24 is of conical configuration to provide an annular nozzle. Immediately before the "primary gas" exits it may be deflected by about 70° by swirl or baffle members configured as guide blades, so that a rotary movement about the longitudinal axis 26 of the jet body 36 or the combustion chamber 16, respectively, is imparted thereto. The "primary gas" is injected into the gas passageway 14 at a pressure of about 1000 to 1200 mm head of water.

The gas passageway 41 is concentrically surrounded by a further gas passageway 18 whose annular inlet port 28 which opens into the combustion chamber 16 is likewise defined by conical side walls 30 and 32. However, the side walls 30, 32 are directed such that they impart a conical flow profile to the gas flow exiting from the annular port 28, said flow profile penetrating the oppositely-directed flow profile of the fuels and of the "primary gas" exiting from the annular port 24. Due to this fact and to the recessed arrangement of the fuel inlet port 10 and the annular port 24 for the "primary gas" relative to the annular port 28 for the so-called "secondary gas", the flow profile of the already rotating fuel or fuel mixture is broken up by the flow of gas or air exiting from sid annular port, i.e. an additional increase in the effective surface of the fuel shortly after it exits from the jet body or shortly after it enters the combustion chamber 16 is obtained.

Before the "secondary gas" flowing through the passageway 18 is discharged, it may likewise be deflected by about 40° to 45° to the longitudinal axis 26, i.e. a rotary motion about the longitudinal axis 26 may be imparted thereto, by swirl members configured as guide blades or the like and disposed in the vicinity of the annular port 28. The discharge velocity of the "secondary gas" is about 120 to 180 m/s, preferably 140 m/s. The annular gap width of the port 28, like the annular gap width of the port 24, is variable by varying the relative positions of the confining side walls 30, 32. Of course, the discharge velocity of the "secondary gas" is variable correspondingly. The "secondary gas" is also injected into the annular passageway 18 at a pressure of about 1000 to 1200 mm head of water. By the way, the deflection of the "secondary gas" preferably is in the same direction as the deflection of the "primary gas" in case such deflection is provided.

Preferably, the "secondary gas" is enriched with hot combustion gases, because it does not so much serve as carrier medium for the fuel introduced into the combustion chamber 16 but rather has the function of increasing the free or effective surface of the fuel and of enriching or supplying the fuel particles with oxygen. Therefore the "secondary gas" preferably is pure "secondary air".

The assembly comprising the jet body 36, the annular passageway 14 immediately surrounding the same and the annular passageway 18 through which "secondary air" flows is adapted to be fitted as a unit into the end wall 12 of the combustion chamber 16 and is therefore easily replaceable by a somewhat modified corresponding assembly.

The discharge velocities of the "primary gas" and the "secondary air" remain approximately the same under all operating conditions between start-up and full load. Only the discharge volume or throughput are varied by correspondingly increasing or decreasing the gap widths of the annular ports or annular gaps 24 and 28. Variation of the gap widths takes place in the same way. To this end an annular mouth piece 34, which is disposed intermediate the two annular ports or gaps 24 and 28 and comprises the two adjacent or mutually facing side walls 22 and 30 of the two annular ports 24 and 28, is mounted so as to be reciprocally movable in axial direction or in the direction of the longitudinal axis 26. The annular mouth piece 34 is joined to a tubular jacket 38 which separates the two gas passageways 14, 18 from one another, so that axial displacement of the annular mouth piece 34 occurs through corresponding action on the tubular jacket 38. Upon start-up the annular mouth piece 34 is moved to the right in the drawing, so that the gap widths of the annular ports 24 and 28 and thus the volume of discharged gases or air are minimum. During full-load operation the relationships are reversed, i.e. the annular mouth piece 34 is displaced to the left so that the degree of opening of the annular ports 24 and 28 is maximum. The discharge volume of the "primary gas" and the "secondary air" is likewise maximum.

The core of the apparatus according to the invention resides in the configuration of the jet body 36, especially of the fuel inlet port 10. The fuel inlet is defined by a central port 10 confined by a continuous knife edge 40. A plurality of air inlet ports 42 evenly distributed about the circumference are associated with said port 10 or knife edge 40. The air inlet ports 42 are in communication with one another via an annular passageway 44 and in fluid communication with a preferably variable source of compressed air (not illustrated) via a common compressed-air passageway 46. The knife edge 40 defining the fuel inlet port 10 has approximately triangular cross-section. The air inlet ports 42 extend approximately as an extension of the inner boundary surface 48 of the triangular knife edge 40. Actually, the air inlet ports 42 each extend at an angle of 70° relative to the longitudinal axis 26 of the jet body 36 or the combustion chamber 16. In the illustrated embodiment the knife edge 40 is part of a mouth piece 50 which is fitted in the jet body 36 and also comprises the air inlet ports 42. The mouth piece 50 is threaded into the jet body (threaded joint 52). The knife edge 40 or, respectively, the inwardly directed tapering edge thereof defines a circular port 10. By means of the knife edge 40 the fuel entering the combustion chamber 16 is spontaneously fanned out to provide a substantially hollow spray cone. The fanned-out spray cone is enveloped, as it were, by the "primary gas" exiting from the annular port 24 immediately surrounding the fuel inlet port 10. The "secondary air" exiting from the annular port 28 then breaks up the spray cone bounded by the "primary gas" in the vicinity of the end wall 12, and consequently minute fuel particles are formed near the end wall 12 so that practically complete combustion may take place within a minimum distance inside the combustion chamber.

By means of the compressed air injected through the air inlet ports 42 it is readily possible to vary the formation of the "spray cone" or match it to the respective desired conditions or to the type and quality of fuel subjected to combustion.

The air inlet ports 42 may also be respectively directed obliquely relative to the radial so as to impart to the exiting fuel/air mixture a rotary motion about longitudinal axis 26, which motion is then preferably in the same direction as the rotary motion of the outer flow of gas or air.

The aforementioned admixing of combustion gases to the "primary gas" offers two advantages. Firstly, both the liquid and the solid fuels can be preheated along their path through the central fuel passageway 54. Secondly, a certain degree of post-combustion and thus improved efficiency may be achieved. These two advantages compensate for the drawback of a lower oxygen content, all the more as said drawback is more than compensated by the admixture of compressed air through the air inlet ports 42. However, in case of pure coal combustion it will be suitable to do without the admixture of combustion gases to the "primary gas" or "primary air", respectively.

All of the features disclosed in the present papers are claimed as being essential to the invention to the extent to which they are novel over the prior art either individually or in combination.

I claim:

1. A method of burning a liquid fuel, said method comprising the steps of:

providing a central fuel inlet port into a combustion chamber, said port being defined by a continuous knife edge with a triangular cross section and being continuously surrounded by a gas and/or air inlet portion;

providing a plurality of air inlets ports radially disposed along a side of said knife edge remote from the combustion chamber, said air inlet ports extending along said side of the knife edge;

introducing the fuel in admixture with compressed air into a combustion chamber via a knife edge so as to be spontaneously fanned out to create a spray cone which opens approximately conically, said spray cone including the fuel in admixture with compressed air being bounded by an external, optionally rotating flow of air.

2. A method as claimed in claim 1, characterized in that the compressed air is admixed with the fuel immediately prior to introduction thereof into the combustion chamber, and that approximately radially towards the fuel.

3. A method as claimed in claim 1, characterized in that the fuel spray cone immediately after entry thereof into the combustion chamber is bounded by an outer, approximately similarly directed flow of "primary gas" to which is then applied an outer flow of "secondary air" to break the spray cone up.

4. A method as claimed in claim 3, characterized in that the flow of primary gas and the flow of secondary air have approximately constant flow velocities under all conditions of operation or load.

5. A method as claimed in claim 3, characterized in that the primary gas is introduced or injected into the combustion chamber in radially outward direction at an angle of about 10° to 30°, preferably about 20°, to the longitudinal axis of said combustion chamber.

6. A method as claimed in claim 3, characterized in that the secondary air is introduced into the combustion chamber while being directed towards the introduced fuel, i.e. directed radially inwardly, at an angle of about 30° to 60°, preferably about 45°, to the longitudinal axis of said combustion chamber.

7. An apparatus for burning liquid fuels introduced into a combustion chamber, said apparatus comprising:

a burning fuel inlet central port opening into the combustion chamber through which the fuel can be led into the combustion chamber, said port being defined by a continuous knife edge with a triangular cross section and being concentrically surrounded by a gas and/or air inlet portion;

a plurality of air inlet ports being approximately evenly distributed about the circumference of the knife edge communicating with each other via an annular passageway and being in fluid communication with a preferably variable source of compressed air via said gas and/or air inlet portion.

8. An apparatus as claimed in claim 7, characterized in that a jet body comprising the fuel inlet is mounted for displacement in the direction of its longitudinal axis or the longitudinal axis of the combustion chamber, respectively, and is especially adapted to be moved to a position in which the fuel inlet is rearwardly offset or recessed relative to the end wall of the combustion chamber.

9. An apparatus as claimed in claim 7, characterized in that the annular gap width of the two gas or air inlet ports adjacent the fuel inlet is respectively variable by varying the relative positions of the side walls which define said inlet ports.

10. An apparatus as claimed in claim 9, characterized in that the annular gap width of the two gas or air inlet ports adjacent the fuel inlet is variable in the same way, i.e. by displacing an annular mouth piece, which comprises the two adjacent side walls of the two air inlet ports, in the direction of the longitudinal axis of the jet body or the combustion chamber, respectively, wherein the annular mouth piece preferably forms a part of the tubular or like jacket which separates the two flows of gas or air adjacent the fuel inlet.

11. An apparatus as claimed in claim 9, characterized in that the air inlet port which is second-nearest to the fuel inlet extends in such a way that the corresponding flow of "secondary air" assumes an approximately hollow cone-shaped flow profile directed towards the fuel spray cone.

12. The method for burning fuel of claim 1 wherein solid fuel, especially coal or peat, in pulverized form is substituted for the liquid fuel.

13. The apparatus for burning fuel of claim 7 wherein solid fuel, especially coal or peat, in pulverized form is substituted for the liquid fuel.

* * * * *